US006293869B1

(12) United States Patent
Kwan et al.

(10) Patent No.: US 6,293,869 B1
(45) Date of Patent: Sep. 25, 2001

(54) SHOOTING GAME TARGET WITH GRAPHIC IMAGE DISPLAY DEVICE

(75) Inventors: David Chu Ki Kwan; Sammy To, both of Hong Kong (CN)

(73) Assignee: Toymax Inc., Plainview, NY (US)

( * ) Notice: Subject to any disclaimer, the term of this patent is extended or adjusted under 35 U.S.C. 154(b) by 0 days.

(21) Appl. No.: 09/475,561

(22) Filed: Dec. 30, 1999

(51) Int. Cl.[7] ..... A63F 9/24

(52) U.S. Cl. ..... 463/51; 463/53; 273/371; 434/33

(58) Field of Search ..... 463/2, 3, 5, 7, 463/30, 31, 37, 49–57; 273/371, 372, 454, 460; 434/16, 22, 21, 20, 19, 23

(56) References Cited

U.S. PATENT DOCUMENTS

| | | | | |
|---|---|---|---|---|
| 4,363,484 | * | 12/1982 | Breslow et al. | 463/51 |
| 4,487,583 | | 12/1984 | Brucker et al. . | |
| 4,533,144 | * | 8/1985 | Juarez et al. | 463/51 |
| 4,629,427 | * | 12/1986 | Gallagher | 434/22 |
| 4,695,058 | * | 9/1987 | Carter, III et al. | 463/51 |
| 4,802,675 | | 2/1989 | Wong et al. . | |
| 4,938,483 | * | 7/1990 | Yavetz | 463/51 |
| 5,672,108 | | 9/1997 | Lam et al. . | |
| 5,741,185 | | 4/1998 | Kwan et al. . | |
| 5,984,788 | * | 11/1999 | Lebensfeld et al. | 463/51 |
| 6,071,166 | * | 6/2000 | Lebensfeld et al. | 463/51 |

OTHER PUBLICATIONS

Instrcutions for Lazer Tag of Tiger Electronics Inc., 1997 Copyright.
Instructions for Sega "Lock On" 1993 Copyright.

* cited by examiner

*Primary Examiner*—Michael O'Neill
(74) *Attorney, Agent, or Firm*—Brown Raysman Millstein Felder & Steiner LLP

(57) ABSTRACT

In a shooting game toy, a target includes a display device that provides different image patterns to facilitate a communication of different states, or changes of state, of a shooting game or the toy. In a preferred embodiment, the display device is an electroluminescent display having a plurality of display elements that are activated in a predefined sequence corresponding to each state or change of state of the shooting game. For example, a routine hit of the target may be visually displayed as an image pattern representative of a conventional "outward burst" pattern, while a reset to a known state may be visually displayed as an inwardly contracting pattern, a destruction of the target as yet another visual pattern, and so on. By providing different display patterns at each target, the state of the game, or a change of state of the Game, is visually communicated to each participant having a view of the target, thereby enhancing the enjoyment of the shooting game.

13 Claims, 6 Drawing Sheets

| | | TIME | 1 | 2 | 3 | 4 | 5 | 6 | 7 | 8 | |
|---|---|---|---|---|---|---|---|---|---|---|---|
| 410 | PATTERN 1 | A | 1 | 0 | 0 | 0 | 1 | 0 | 0 | 0 | 411 |
| | | B | 0 | 1 | 0 | 0 | 0 | 1 | 0 | 0 | 412 |
| | | C | 0 | 0 | 1 | 0 | 0 | 0 | 1 | 0 | 413 |
| 420 | PATTERN 2 | A | 0 | 0 | 0 | 0 | 1 | 1 | 1 | 1 | 421 |
| | | B | 0 | 0 | 1 | 1 | 0 | 0 | 0 | 0 | 422 |
| | | C | 1 | 1 | 0 | 0 | 0 | 0 | 0 | 0 | 423 |
| 430 | PATTERN 3 | A | 1 | 1 | 1 | 1 | 1 | 1 | 1 | 1 | 431 |
| | | B | 1 | 1 | 0 | 0 | 1 | 1 | 1 | 0 | 432 |
| | | C | 1 | 0 | 0 | 0 | 0 | 1 | 0 | 0 | 433 |

SHOOTING GAME TARGET WITH GRAPHIC IMAGE DISPLAY DEVICE

BACKGROUND OF THE INVENTION

This invention relates to toy shooting games which include a shooter device and a target.

U.S. Pat. No. 5,741,185 and others disclose shooting game toys which include a shooter device and a target. Generally, in such toys, the shooter device resembles a weapon such as a pistol, a rifle, or other weapon shape can be aimed at a target. The shooter device typically includes an emitter that transmits a signal, such as a light beam, along a line of sight corresponding to the aiming of the device when a firing mechanism of the device such as a trigger is activated. The corresponding target includes a detector that detects the transmitted signal when the detector and the shooter device are registered along a line of sight between them. While in some toys the shooter device emits the signal, in other toys, the target emits the signal which is detected by the shooter device when the shooter device is aimed along the line of sight to the target and the shooter device's firing mechanism is activated to enable detection rather than firing. In both types of toys, upon detection, the target or the shooter device registers a "hit".

One or more persons may play with such toys, which may be used in competitive and non-competitive modes. In a competitive mode, two or more players wear or otherwise carry targets and each player accumulates points by successfully achieving hits between a shooter device carried by one player and a target worn or carried by another player. In a non-competitive mode, the target is placed on a stationary or moving object, and the player scores points by successfully achieving hits between a shooter device and a target.

Toys of the above type may have different playing modes and associated sets of rules. See, for example, U.S. patent application Ser. No. 09/015,863, titled "Player Programmable, Interactive Toy for a Shooting Game" and Ser. No. 09/019,747, titled "Computer Programmable, Interactive Toy for a Shooting Game". The disclosures of these two patent applications and U.S. Pat. No. 5,741,185 are incorporated herein by reference.

There is a need for shooting game toy which has a target that provides easily recognizable status information.

The "Laser Challenge Radar Extreme" shooting toy sold by Toymax Inc., which has been commercially available for less than one year prior to the filling date of this application, incorporates the invention disclosed herein.

OBJECTS AND SUMMARY OF TFIE INVENTION

It is an object of the invention disclosed herein to enhance the communication of the state or status of a shooting game toy or the game among the participants of the game.

It is another object of the invention to enhance the play value of shooting game toys.

The above and other objects and others are achieved by a shooting game toy which provides status information graphically. Graphics can provide visual effects that are both easily recognizable and which add to the play value of the toy.

A display device for a shooting game toy which incorporates the invention provides different image patterns (the term "pattern" encompasses sequences) to facilitate a communication of different states or statuses, or changes of state or status, of the toy or game. The state or status of the shooting game or toy may include, a state or status of a target device and/or a shooter device. For example, such states and statuses may include the number of hits scored at a target, a reset to known reset conditions, the type of shots fired by the shooter device, the current relationship of the shooter device to the target, the status of each target (active/inactive or destroyed), and so on.

For example, a routine hit of the target may be visually displayed as a first image pattern, e.g., representative of an "outward burst" pattern, while a hit of the target by a different form of ammunition may be visually displayed as a second image pattern, e.g., representative of multiple overlapping outward burst patterns. A reset to a known state may be visually displayed as a third image pattern, e.g., an inwardly contracting pattern. A destruction (virtual) of the target may be visually displayed as yet another image pattern, and so on. The image patterns may be defined by dynamic sequences of images or static images.

The various image patterns provided on the display are preferably relatively easily differentiated from each other so that a game participant or player need only glance at the target to understand the state or status information intended to be conveyed by the display. Preferably, a unique sound or sounds (which encompass tones, sequences, patterns, etc.) accompany each unique image pattern. This facilitates a quick and easy understanding of the state or status intended to be conveyed, even under difficult or dynamic game or background conditions. For example, a sequence may be defined by illumination of elements in a given order (e.g., element 1, followed by element 2, followed by element 3) or by a state combination (e.g., elements 1 and 3 together).

In a preferred embodiment, the display device is an electroluminescent display having a plurality of display elements that are activated in a predefined sequence or a preferred combination corresponding to each state or status or change thereof of the shooting game. By providing different display patterns at each target, the state or status of the game, or a change thereof, is visually communicated to each participant having a view of the target, thereby enhancing the play value of the shooting game. In a preferred embodiment, annular, concentrically arranged display elements (or sets of display elements) are provided.

BRIEF DESCRIPTION OF THE DRAWINGS

The invention is illustrated in the figures of the accompanying drawings which are meant to be exemplary and not limiting, in which like references in the different figures refer to like or corresponding parts, and in which.

DESCRIPTION OF THE PREFFERED EMBODIMENTS

Figure 1:
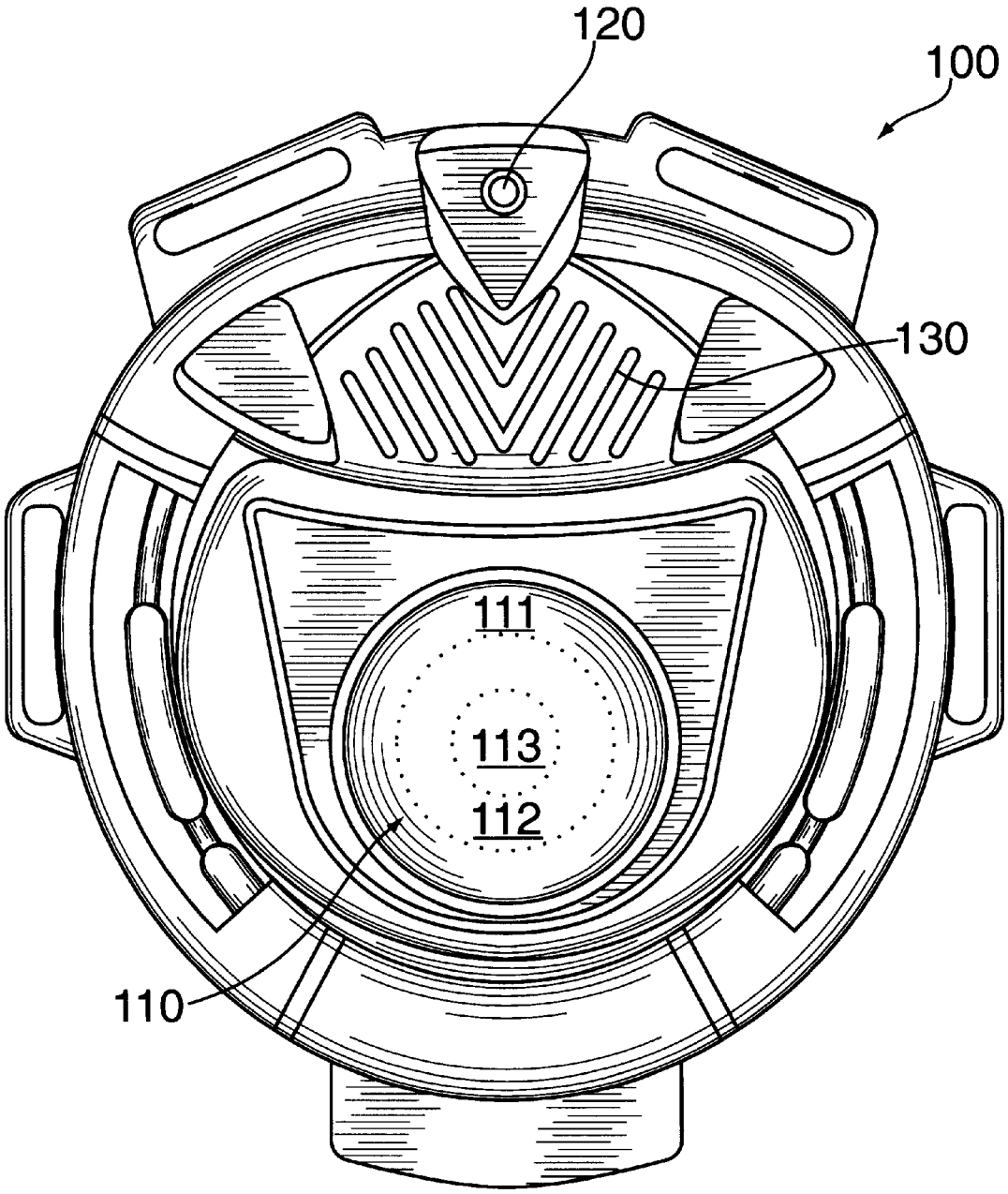
FIG. 1 is a front view of target with a display device incorporating the invention.
Figure 2:
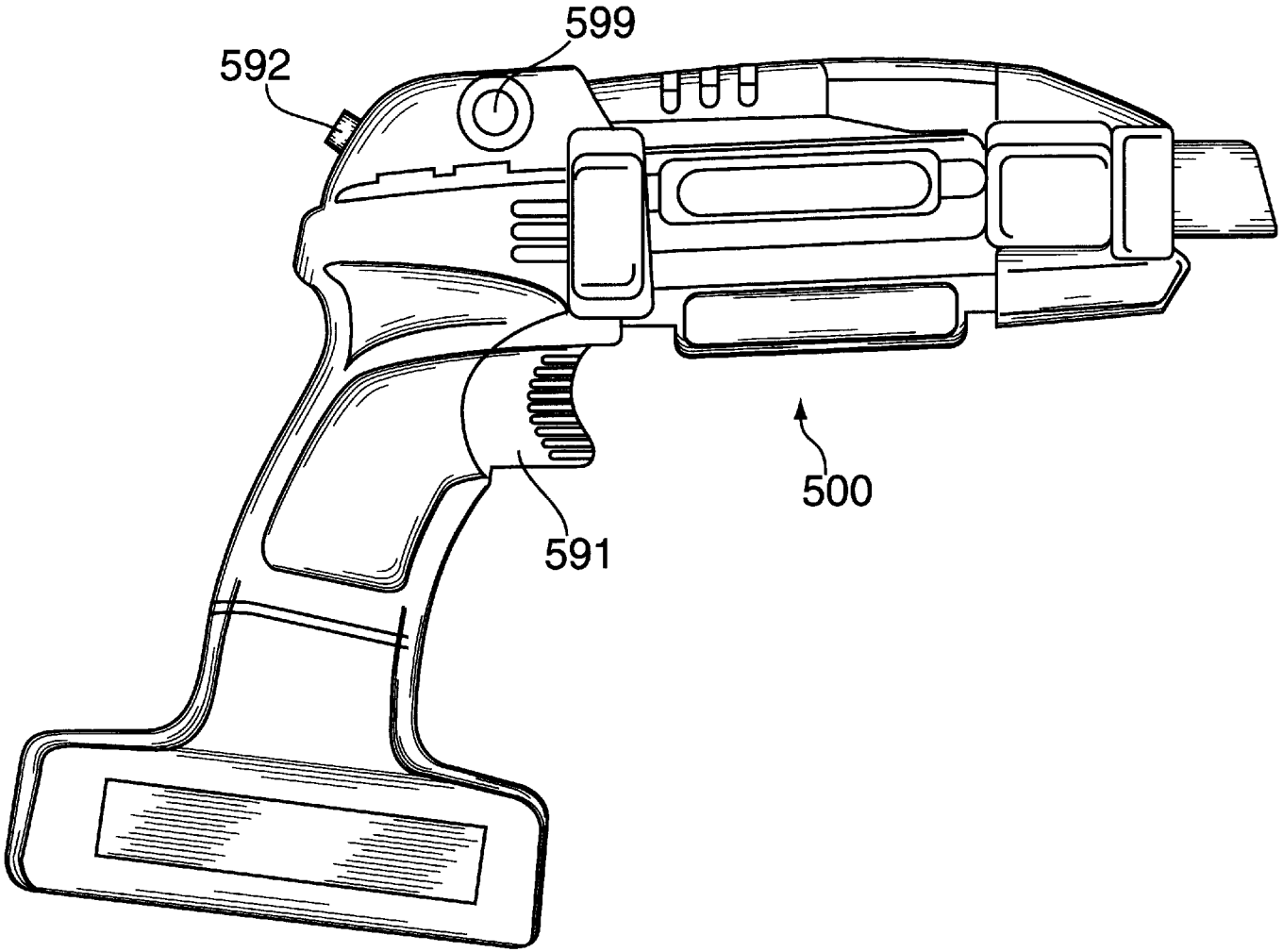
FIG. 2 is a side view of a shooter device used with the target depicted in FIG. 1.
Figure 4:
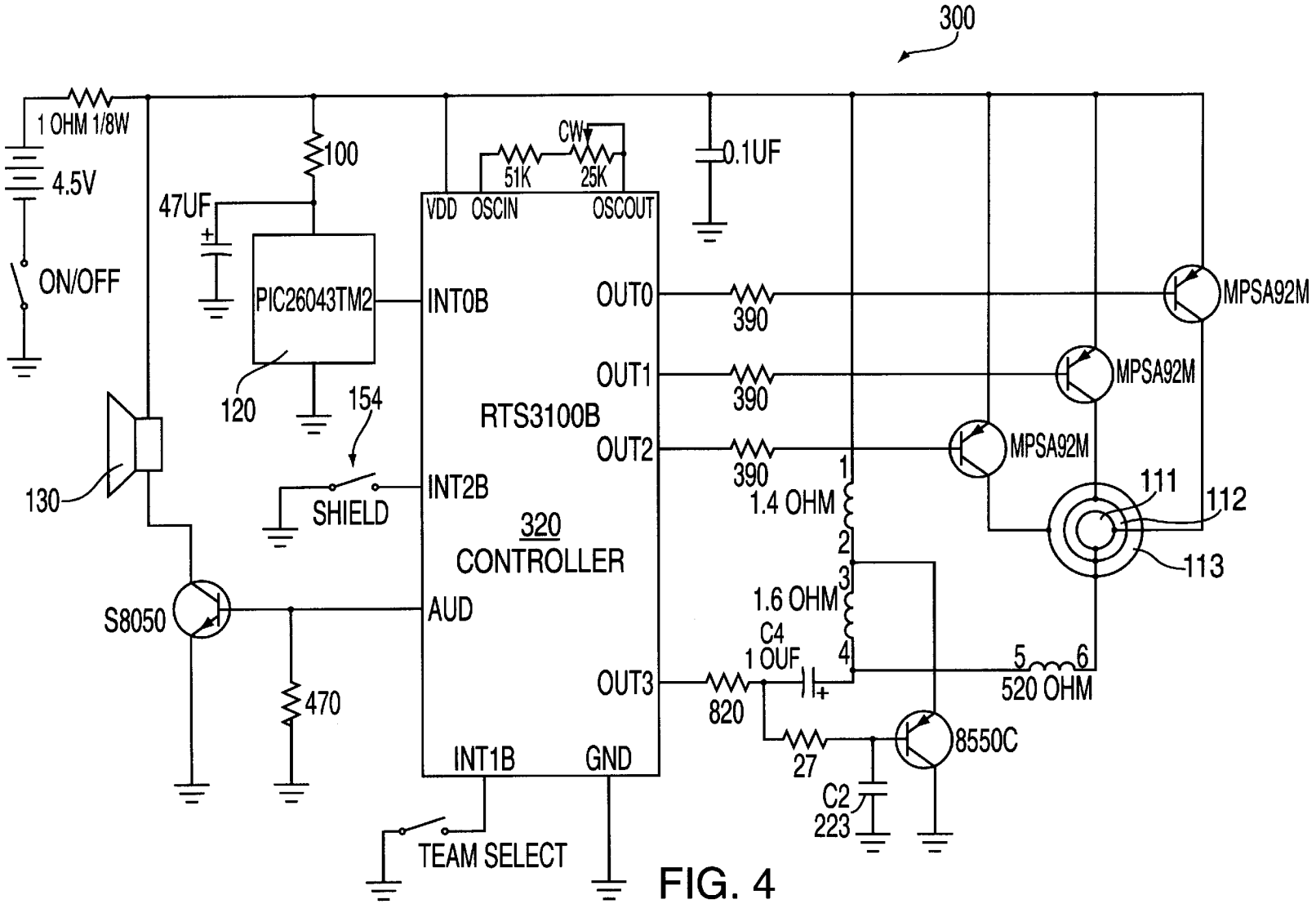
FIG. 4 is a block diagram of an electronic circuit of a target device depicted in FIG. 1.

A target 100 for a shooting game toy as depicted in FIGS. 1 and 4 includes a display device 110 in accordance with this invention. The target 100 also includes a detector device 120, an audio device 130, and may include other devices. A game is played using a target 100 and a shooter device 500 (FIG. 2). The shooter device 500 provides communications to the target device 100, which detects and decodes the communications and provides appropriate image patterns on display device 110 in response thereto.

The display device 110 allows for the display of different image patterns, each image pattern or combination of image patterns being representative of a state or status of a game or the toy. The state or status, or change thereof of a shooting game or of the toy may include a variety of parameters, such as the status of the shooter device, the status of the target, the type or mode of game being played, hit or other parameter history, and so on.

Figure 3:
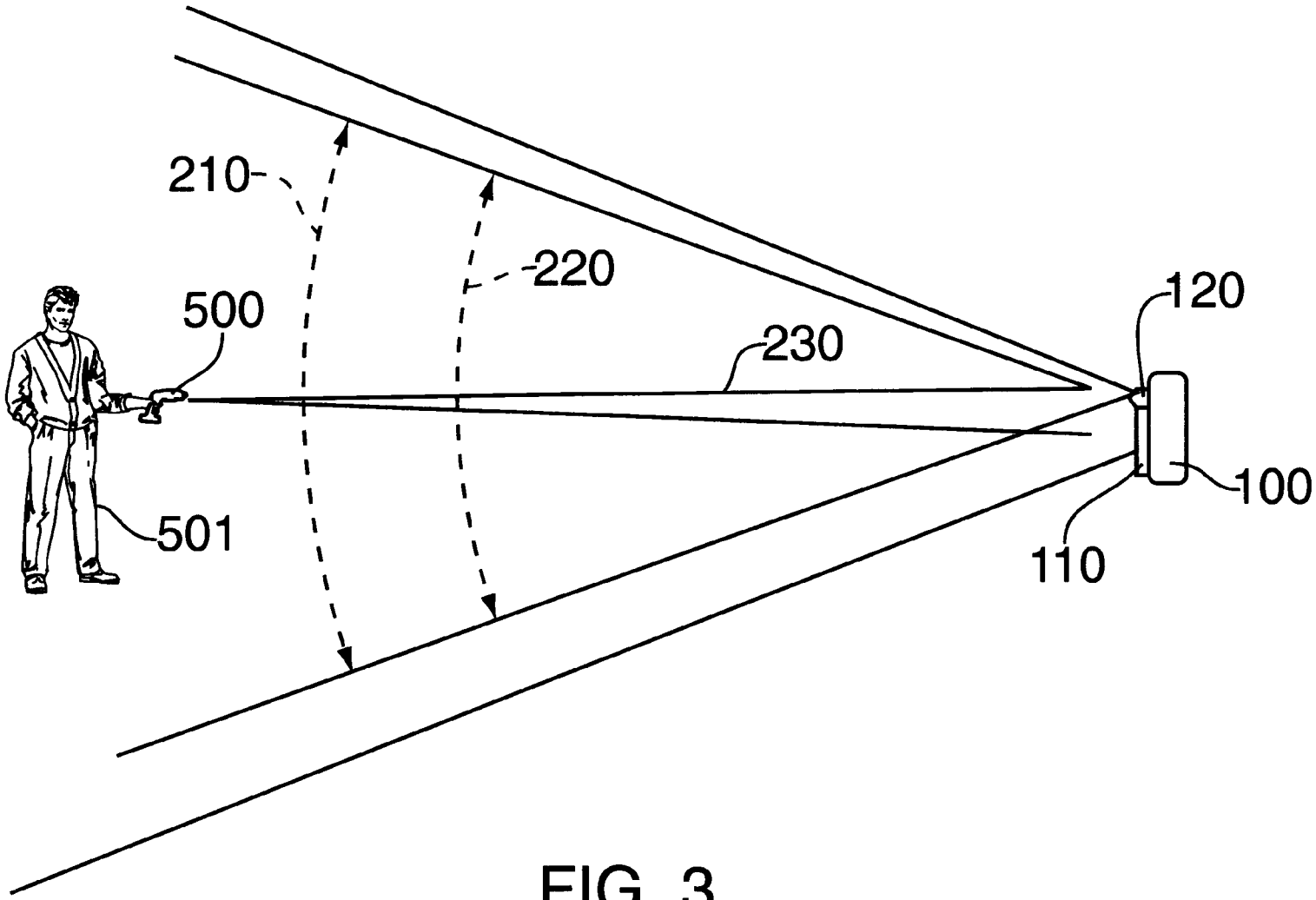
FIG. 3 is a diagram illustrating a shooting game with a display device in accordance with this invention.

As illustrated in FIG. 3, in a preferred embodiment, the display device 110 is mounted on the target 100 such that a wide field of view 210 is provided. For example, the display device field of view 210 may substantially overlap and/or substantially include the field of view 220 of the detector 120. The field of view 210 of the display device 110 is the angular span within which the pattern on the display 110 can be viewed; the field of view 220 of the detector 120 is the angular span within which an emission can be detected. By substantially overlapping or including the field of view 220 of the detector 120 within the field of view 210 of the display 110, a user 501 of a shooter device 500 that is able to communicate a change of state or status (230) of the shooting game or a component thereof to the target is provided a view of the display 110. When the user 501 communicates a change of state 230, or communicates a message that conditionally effects a change of state 230, to the target 100, a confirmation of the change of state can be visually communicated from the target 100 to the user 501. For example, if the user 501 resets the game to an initial state, and communicates this to the target 100 via the shooter device 500, the target 100 in a preferred embodiment confirms that it has been reset to the initial state via a particular image pattern (which, as mentioned, encompass a sequence) on the display device 110. An image pattern can easily be discerned by a shooter, for example during active play while devoting little attention to the target, such as by simply glancing at the display device 110.

By visually communicating a change of state or status of the game from the target 100 to the user 501, the play value of the game is enhanced, because the user 501 may determine the proper game state or status without, for example, having to closely approach the target 501. Audio signaling may also be provided, as disclosed for example in the cited patent and patent applications, but the use of a display device 110 to provide graphic visual signaling facilitates a more reliable, more entertaining communication, particularly in dynamic and difficult game or background conditions such as high noise and poor visibility. Additionally, distinctive visual patterns may be more discernible from a distance than distinctive audio patterns.

Any of a variety of techniques may be used to provide multiple image patterns corresponding to multiple game states. Conventional graphic display devices, such as CRTs, LCDs and LEDs may be used, however a CRT may not be suitable for a portable application, and an LCD may not present an image that is viewable at a significant distance, and LEDs may not present a pattern which is as continuous or uniform as they could be. In a preferred embodiment, the display 110 (FIGS. 1 and 4) is an electroluminescent display that contains multiple segments 111, 112, 113, etc., that are individually controllable. Such an embodiment has the advantages of light weight, low cost, and high visibility at a distance. Differing games and applications may preferably employ alternative multiple-image display devices, each with its own advantages and disadvantages.

Elements that arranged in concentric circles, such as annular elements 111, 112, and 113, or sets of LEDs, etc., provide simple image patterns that are easily distinguishable at a distance. For example, by illuminating the center element 111, then the next-outer element 112, then the outer-most element 113, an expanding "burst" pattern is displayed. Repeatedly illuminating the three elements simultaneously provides a "flashing" pattern that is easy to distinguish from the expanding burst pattern, even at a substantial distance. Coupling the image pattern to a corresponding audio sound or sounds may also enhance the image recognition. These and other techniques of producing distinguishable image patterns on a display 110 will be evident to one of ordinary skill in the art, including variations of color, luminance, frequency, duty cycle, and so on.

FIG. 4 illustrates a block diagram of an electronic circuit 300 that may be employed in the target device 100. As illustrated, the detector 120 provides an input to a controller 320. Infrared emitters and detectors are preferably used in the shooter device and target device, respectively, so that detector 120 may comprise an IR receiver. The cited U.S. patent and patent applications present techniques for producing a coded communication from the shooter device. Coding may be implemented using amplitude modulation, pulse code modulation, pulse width modulation, and others. The controller 320 determines the code being communicated from the shooter device, based on the received coded communication detected by the detector 120. In response to the received code, the controller 320 provides a signal to the display device 110 (through a driver circuit) corresponding to the received code, or corresponding to a change of state or status of the target 100 in response to the received code. These signals effect an illumination of corresponding segments 111, 112, and 113, of display 110, respectively. In a preferred embodiment, a memory, which may be embodied within the controller 320, stores the information necessary to provide the desired image patterns on the display 110, and also contains the appropriate mapping between communicated states or status, or changes thereof and the image patterns that are to be displayed.

Figures 5, 7:
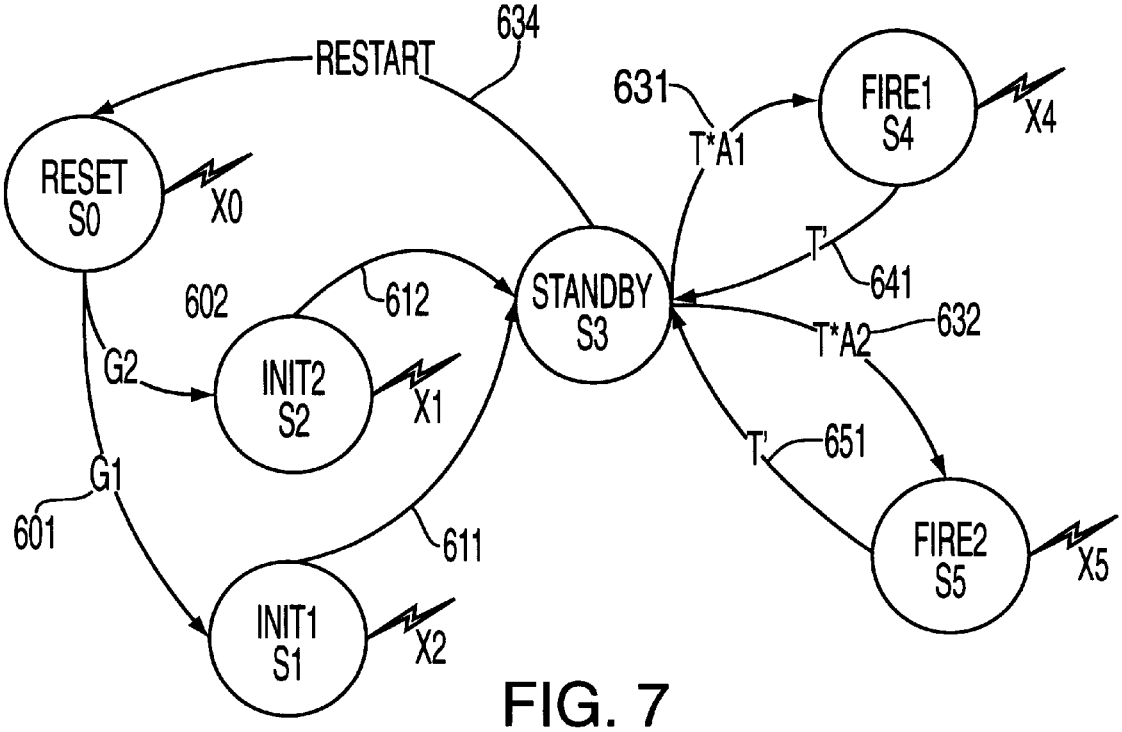
FIG. 5 illustrates a set of display patterns for a the display device depicted in FIG. 1 sequentially activated in accordance with this invention.
FIG. 7 is a state diagram of a shooter device in accordance with the invention.

FIG. 5 illustrates an illustrative a hypothetical set of display patterns 410, 420, 430, etc., which may be stored in the memory of the controller 320 of FIG. 4 and which may be provided for a sequentially activated display. Each pattern includes a sequence of 0's (no-illumination) and 1's (illumination) associated with each of the stimuli A, B, and C. For example, pattern 410 comprises sequences 411, 412, and 413. Sequence 411 ("10001000") indicates an illumination of the A element 111 at a first time interval, then a non-illumination for three time intervals, then another illumination interval, then another three illumination intervals. Similarly, sequence 412 ("01000100") indicates an illumination of element 112 on the second and sixth time intervals, and sequence 413 ("00100010") indicates an illumination of element 113 on the third and seventh time intervals. Thus, the application of the pattern 410 will effect two cycles of the aforementioned expanding burst pattern. In like manner, the sequences 421, 422, 423 of pattern 420 will effect a contracting pattern that contracts at half the rate of the expanding burst pattern 410, with an illumination of the center element 111 corresponding to sequence 411 ("00001111") during the last four time intervals. Pattern 430 illustrates a contracting-expanding-contracting pattern produced by sequences 431, 432, and 433.

As would be evident to one of ordinary skill in the art, alternative patterns, including longer or shorter sequences can be defined, and the controller 320 of FIG. 4 can be configured to repeatedly apply a given pattern, apply combinations of patterns, and so on, to provide the desired visible effect.

Figure 6:
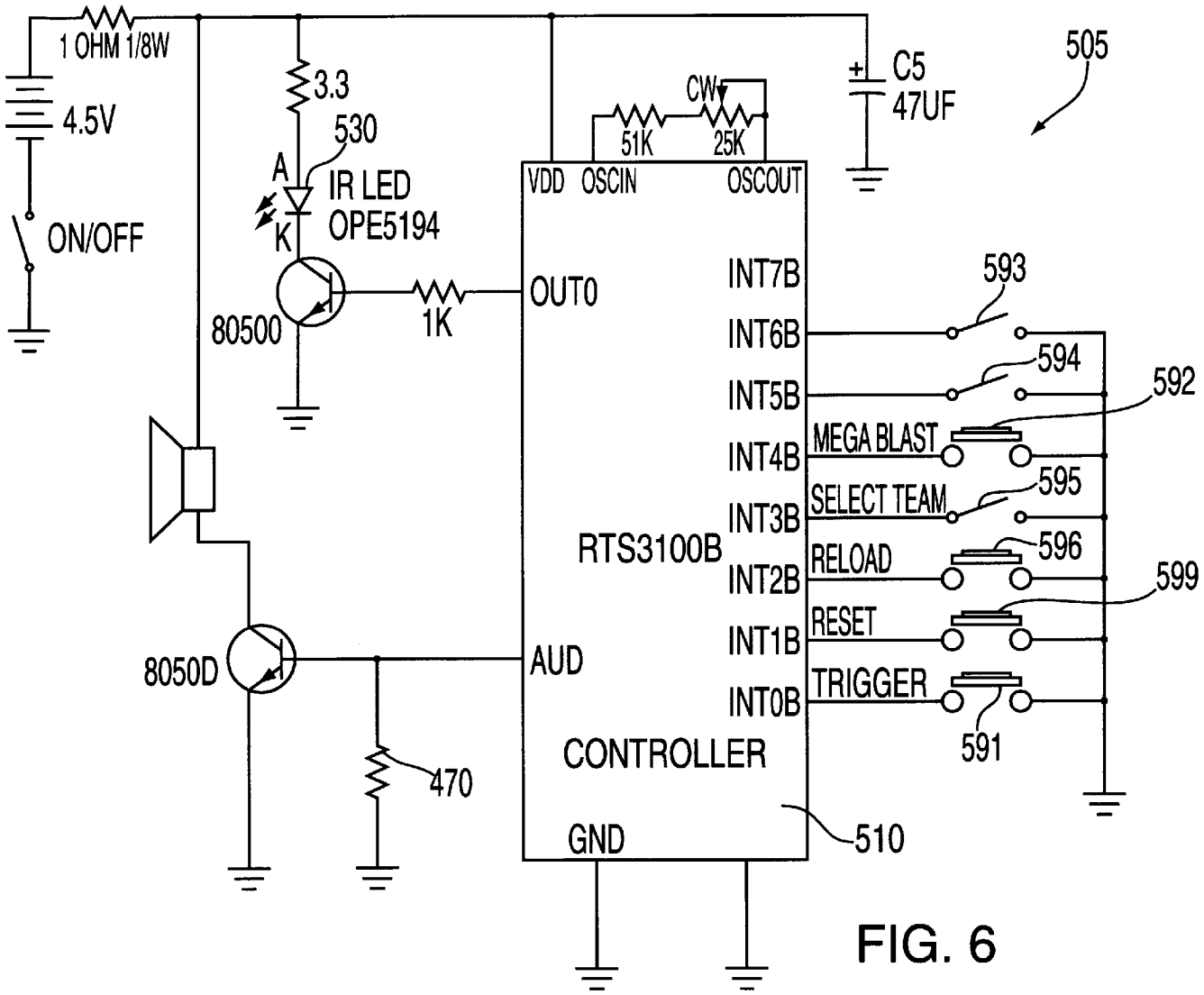
FIG. 6 is a block diagram of an electronic circuit for shooter device represented in FIG. 2.

FIG. 6 illustrates a block diagram of an electronic circuit 505 that may be employed in the shooter device 500. In this example block diagram, a controller 510 controls transmission of state information via an emitter 530. A memory in the controller 510 stores state information 515 and other information. The state information 515 generally includes the state of the shooter device 500, (.e.g., one shot/multiple hit) and an indication of an initial state of the target device. In a preferred embodiment of this invention, the shooter device 500 communicates an intended initial state to the target, and the target acknowledges receipt of this intended-state communication via a visual display of a particular image pattern and audio sound, tone, sequence or pattern. Other acknowledgements of communications, or changes of states at the target are also communicated via the selection of particular image patterns, as discussed above.

The state of the shooter device 500 is determined by a number of factors, depending upon the complexity of the shooter device 500. Similar to an embodiment described in the aforementioned U.S. Pat. No. 5,741,185, the shooter device 500 (FIGS. 2 and 6) includes a trigger switch 591 and a reset switch 599. The reset switch 599 is provided to reset the game state to an initial state. Other switches may be provided, as disclosed for example in the aforementioned U.S. patent applications and in the "Laser Challenge Radar Extreme". The trigger switch 591 is used to place the shooter device 500 into a "fire" state, and the controller 510 is configured to communicate a different code corresponding to this fire state than the code that is used to communicate the reset state. In accordance with this invention, the display device 100 is configured to render different image patterns (for example, images corresponding to patterns 410–450 of FIG. 5) in response to the receipt and processing of different codes from the shooter device 500.

The block diagram of the electronic circuit 505 of the shooter device 500 in FIG. 6 illustrates other switches included on the shooter device 500 in the "Laser Challenge Radar Extreme" embodiment that are used to modify the state of the game. Switches 591–596, 599 are illustrated in the circuit diagram of FIG. 6, although alternative switching means are common in the art, including for example, a download of information from a memory device, a presetting of the controller 510 to default values on power-up, and so on. (Some of the switches 591–596, 599 are not shown in FIG. 2). A variety of features may be included in the shooter device 500 via the use of different shooter states. For example, switch 592 is labeled as the "Mega Blast" switch. When this switch 592 is activated, the controller 510 communicates a different state identification 515 to the emitter 530 upon a subsequent activation of the trigger 591. The controller 510 in a preferred embodiment also applies rules associated with the various states. In response to a receipt of this different code, signifying a hit with a "Mega Blast", the target 100 of FIG. 1 displays a different image pattern, letting the user of the shooter device, and other viewers, know that a Mega Blast hit had occurred. As mentioned above, apprising the participants of a game with an up-to-date status of the game can significantly enhance the enjoyment of the game. Other switches may effect other states.

FIG. 7 illustrates an example state diagram 600 of the shooter device 500 of FIG. 6 in accordance with this invention. When the device 500 is powered on, it enters a reset state S0, from which it enters one of two initialization states S1 or S2 in dependence upon the setting of the game mode switches 593, 594 of FIG. 6, signified by transfer conditions G1 601 and G2 602 of FIG. 7. While in the reset state S0, the transmitter 520 is configured to transmit a coded communication, represented by transmission X0 from the reset state S0 in FIG. 7. In like manner, while in state S1 or S2, a corresponding transmission X1 or X2 is transmitted. As noted above, the reset transmission X0 is intended to initialize the target, and different initialization transmissions X1, X2 may effect different initial conditions at the target, such as the amount of damage (hits) required to incapacitate the target, and so on. The shooter device then enters a standby state S3. Note that in accordance with the principles of this invention, the target 100 selectively displays different image patterns in response to these coded transmissions X0, X1, X2. If the user of the shooter device 500 does not perceive the expected image pattern at the target 100, the user immediately recognizes that the target 100 has not been initialized properly, and can reassert the reset button 599 as required to effect a restart transfer 634 to the reset state SO for a repeated transmission of the appropriate codes X0, X1, X2. Note that the state diagram of FIG. 7 is provided for illustration purposes, particular shooter devices 500 will have different state configurations, different transmission schemes, and so on. Note also that not all states effect a transmission from the shooter device 500, nor do all received transmissions from the shooter device effect a display at the target.

From the standby state S3, transitions 631, 632, 633 to alternative states S4, S5, S6 are effected based on the status of the trigger switch and other signals. A transfer 631 to state S4 occurs when the trigger is pressed (T) and the ammunition is of a first type (single shot/single hit) (A1). A transfer 632 to state S5 occurs when the trigger is pressed (T) and the ammunition is of a second type (single shot/single hit) (A2). At each state S4, S5 a different transmission X4, X5 occurs. As noted above, the target displays a different image in response to a receipt of each message, signaling a different level of inflicted damage for a hit with each type of ammunition. When the trigger is released (T'), the system returns to the standby state S3, at 641, 651.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the purpose of the display of select image patterns in response to the received coded communication has been presented as being primarily to provide visual feedback to participants in the shooting game. Other uses and benefits of providing select images in response to states or changes of state of the game may be determined in view of this invention.

The example embodiments of the figures are presented for illustration purposes. Alternative structures and arrangement of functions are also feasible. The principles of this invention may be embodied in hardware, software, or a combination of both. For example, the controller 320 of FIG. 4 or controller 510 of FIG. 6 may be embodied as a program that is operated on an embedded processor device, a programmed gate array, a custom designed integrated circuit, or a collection of discrete electronic devices. In like manner, a transmitter device may be provided separate from the controller 510. These and other system configuration and optimization features will be evident to one of ordinary skill in the art in view of this disclosure, and are included within the scope of the following claims.

What is claimed is:

1. A target for a shooting game comprising:

a detector that is configured to detect a coded communication from a shooter device, the coded communication comprising a selected code of a plurality of codes, and a display device that is configured to present a selected image pattern of a plurality of image patterns in dependence upon the detected code, thereby facilitating a visual communication of detection by the target of a coded communication.

2. The target of claim 1 including:

an audio device controlled to present a selected audio sound or sounds in dependence upon the detected code.

3. The target of claim 1 wherein the display device includes at least one of: an electroluminescent device, a liquid crystal device, and a set of light emitting devices.

4. The target of claim 1 wherein the display device includes a set of display elements fixedly arranged relative to each other, and the selected image pattern includes a predefined sequence of activation signals that selectively activate one or more display elements of the set of display elements.

5. The target of claim 4 wherein the set of display elements include a set of concentrically arranged annular elements.

6. The target of claim 1 wherein the detector includes an infrared light detector, and the coded communication includes an encoded sequence of infrared light emissions corresponding to the selected code.

7. A shooting game toy comprising:

a shooter device that is configured to emit a coded communication that includes a selected code of a plurality of codes, a target that is configured to detect the coded communication and to display a selected image pattern of a plurality of image patterns in dependence upon the detected code.

8. The shooting game toy of claim 7 wherein the shooter device includes an infrared light emitter, the target includes an infrared light detector, and the coded communication includes an encoded sequence of infrared light emissions.

9. The shooting game toy of claim 7 wherein the shooter device includes:

at least one switch that is configured to effect a selection of the selected code that is included in the coded communication, and an emitter that is configured to emit the coded communication for reception at the target.

10. A shooting game of claim 7 wherein the target includes a display device that includes at least one of: an electroluminescent device, a liquid crystal device, and a set of light emitting elements.

11. The shooting game of claim 7 wherein the target includes a display device that includes a set of display elements fixedly arranged relative to each other, and the selected image pattern includes a predefined sequence of activation signals that selectively activate one or more display elements of the set of display elements.

12. The shooting game toy of claim 7 wherein the target includes an audio device controlled to present a selected audio sound or sounds in dependence upon the detected code.

13. The shooting game toy of claim 7 wherein the target includes a display device that includes a set of concentrically arranged annular display elements.

* * * * *